US012376667B2

(12) United States Patent
Hoskin-Green et al.

(10) Patent No.: US 12,376,667 B2
(45) Date of Patent: Aug. 5, 2025

(54) PACKAGED COSMETIC STICK PRODUCT

(71) Applicant: Conopco, Inc., Englewood Cliffs, NJ (US)

(72) Inventors: Leonard Geoffrey Hoskin-Green, Bristol (GB); Benjamin George Oglesby, Leeds (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 18/710,986

(22) PCT Filed: Nov. 9, 2022

(86) PCT No.: PCT/EP2022/081277
§ 371 (c)(1),
(2) Date: May 16, 2024

(87) PCT Pub. No.: WO2023/094160
PCT Pub. Date: Jun. 1, 2023

(65) Prior Publication Data

US 2025/0009107 A1 Jan. 9, 2025

(30) Foreign Application Priority Data

Nov. 29, 2021 (EP) ..... 21210994

(51) Int. Cl.
*A45D 40/08* (2006.01)
*A45D 40/00* (2006.01)
*A45D 40/16* (2006.01)

(52) U.S. Cl.
CPC ..... *A45D 40/08* (2013.01); *A45D 2040/0062* (2013.01); *A45D 40/16* (2013.01)

(58) Field of Classification Search
CPC ..... A45D 40/08; A45D 2040/0062; A45D 40/00; A45D 40/16
(Continued)

(56) References Cited

U.S. PATENT DOCUMENTS 2,913,103 A 11/1959 Isele
3,656,628 A 4/1972 Dulberg
(Continued)

FOREIGN PATENT DOCUMENTS

CN 1306403 8/2001
CN 201731234 2/2011
(Continued)

OTHER PUBLICATIONS

Search Report in EP19153386; Jun. 4, 2019; European Patent Office (EPO).
(Continued)

*Primary Examiner* — David J Walczak
(74) *Attorney, Agent, or Firm* — GREENBERG TRAURIG, LLP

(57) ABSTRACT

A packaged cosmetic stick product comprising a cosmetic stick composition mounted on an axially immobile retaining member, the retaining member being reversibly connected to a holder enabling the cosmetic stick product to be held in the human hand, wherein the retaining member comprises arcuate bridge structures separated by holes, the bridge structures arcing into the cosmetic stick composition and being embedded therein.

15 Claims, 4 Drawing Sheets

(58) Field of Classification Search
USPC ..... 401/49, 88
See application file for complete search history.

(56) References Cited

U.S. PATENT DOCUMENTS

| | | | | |
|---|---|---|---|---|
| 4,235,557 | A | 11/1980 | Hayes | |
| 4,915,234 | A | 4/1990 | Boeller | |
| 5,092,700 | A | 3/1992 | Susini et al. | |
| 5,240,337 | A | 8/1993 | Gruner | |
| 5,468,084 | A | 11/1995 | Boninsegni et al. | |
| 5,496,122 | A | 3/1996 | Fattori | |
| 5,738,123 | A | 4/1998 | Szekely | |
| 5,799,667 | A | 9/1998 | Szekely | |
| 5,813,784 | A | 9/1998 | Durliat | |
| 6,293,719 | B1 | 9/2001 | Ohba | |
| 6,688,795 | B1 | 2/2004 | Jacob et al. | |
| 8,651,308 | B1 | 2/2014 | Sung | |
| 8,888,391 | B2 * | 11/2014 | Teller | A45D 40/12 206/385 |
| 8,961,048 | B2 | 2/2015 | Baines et al. | |
| 10,039,366 | B1 | 8/2018 | Facer et al. | |
| 10,492,586 | B2 | 12/2019 | Paquet | |
| 10,542,814 | B2 | 1/2020 | Kelders et al. | |
| 10,799,007 | B2 | 10/2020 | Schlatter et al. | |
| 11,406,168 | B2 | 8/2022 | Briana et al. | |
| 11,839,287 | B2 | 12/2023 | Arora et al. | |
| 2005/0178785 | A1 | 8/2005 | Erickson | |
| 2006/0233589 | A1 | 10/2006 | Heukamp | |
| 2008/0145133 | A1 | 6/2008 | Palmer | |
| 2010/0129135 | A1 | 5/2010 | Stange et al. | |
| 2015/0344288 | A1 | 12/2015 | Ortega Collado | |
| 2017/0007003 | A1 | 1/2017 | Paquet | |
| 2017/0164716 | A1 | 6/2017 | Lee | |
| 2017/0215552 | A1 | 8/2017 | Keller et al. | |
| 2018/0027947 | A1 | 2/2018 | Quennessen et al. | |
| 2018/0072483 | A1 | 3/2018 | Meranus | |
| 2018/0344011 | A1 | 12/2018 | Paquet | |
| 2022/0160101 | A1 | 5/2022 | Zhou | |
| 2022/0378175 | A1 | 12/2022 | Van Der Blom et al. | |

FOREIGN PATENT DOCUMENTS

| | | |
|---|---|---|
| CN | 104687718 | 6/2015 |
| CN | 105050911 | 11/2015 |
| CN | 106572946 | 4/2017 |
| DE | 9318425 | 5/1994 |
| FR | 2726442 | 5/1996 |
| FR | 2729279 | 7/1996 |
| FR | 2882235 | 8/2006 |
| GB | 598838 | 2/1948 |
| JP | 9252837 | 9/1997 |
| JP | 10179250 | 7/1998 |
| JP | 2002291527 | 10/2002 |
| JP | 2010178828 | 8/2010 |
| JP | 2014161637 | 9/2014 |
| JP | 2015009961 | 1/2015 |
| JP | 2018153233 | 10/2018 |
| KR | 101837581 | 3/2018 |
| RU | 2199256 | 2/2003 |
| RU | 2299663 | 5/2007 |
| RU | 2438545 | 1/2012 |
| WO | WO9405180 | 3/1994 |
| WO | WO0008970 | 2/2000 |
| WO | WO2005068308 | 7/2005 |
| WO | WO2007093286 | 8/2007 |
| WO | WO2011071792 | 6/2011 |
| WO | WO2012141522 | 10/2012 |
| WO | WO2013118969 | 8/2013 |
| WO | WO2017078745 | 5/2017 |
| WO | WO2018202385 | 11/2018 |
| WO | WO2020152223 | 7/2022 |

OTHER PUBLICATIONS

Search Report in EP19153387; Jun. 4, 2019; European Patent Office (EPO).
Search Report and Written Opinion in EP19204993; Jan. 31, 2020; European Patent Office (EPO).
Search Report and Written Opinion in PCTEP2020051523; Mar. 17, 2020; World Intellectual Property Org. (WIPO).
Search Report and Written Opinion in EP20193038 ; Feb. 10, 2021; European Patent Office (EPO).
Search Report and Written Opinion in PCTEP2020079453; Nov. 11, 2020; World Intellectual Property Org. (WIPO).
Search Report and Written Opinion in PCTEP2020051524; Mar. 17, 2020; World Intellectual Property Org. (WIPO).
IRPR2 in PCTEP2020051523; Apr. 9, 2021; World Intellectual Property Org. (WIPO).
Refills; MyMyro.com; 2023; 13 pages, retrieved 2023 from https://www.mymyro.com/collections/all#refills.
Search Report and Written Opinion in PCTEP2022081277; Jan. 27, 2023; World Intellectual Property Org. (WIPO).
Search Report and Written Opinion in PCTEP2021073370; Nov. 24, 2021; World Intellectual Property Org. (WIPO).
IPRP1 in PCTEP2021073370; Mar. 9, 2023; World Intellectual Property Org. (WIPO).
IPRP1 in PCTEP2020051524; Aug. 5, 2021; World Intellectual Property Org. (WIPO).
Written Opinion of the IPEA in PCTEP2020051523; Dec. 17, 2020; World Intellectual Property Org. (WIPO).
Search Report and Written Opinion in EP23170506; Jul. 11, 2023; European Patent Office (EPO).
IPRP1 in PCTEP2020079453; May 5, 2022; World Intellectual Property Org. (WIPO).
Search Report and Written Opinion in EP21210994; May 20, 2022; European Patent Office (EPO).

* cited by examiner

PRIOR ART

PACKAGED COSMETIC STICK PRODUCT

RELATED APPLICATIONS

The present application is a national phase filing under 35 USC 371 of International Application No. PCT/EP2022/081277, filed on Nov. 9, 2022, which claims priority from European Patent Application No. 21210994.6, filed on Nov. 29, 2021, the contents of which are incorporated herein in their entirety for all purposes.

FIELD OF INVENTION

The field of the invention is packaged cosmetic stick products, in particular the packaging/dispensers therefor.

BACKGROUND

The invention relates to a cosmetic stick product (for example, a deodorant and/or antiperspirant product for application to human axillary regions) and associated packaging/dispenser. More specifically, the invention relates to a package/dispenser for deodorant stick products wherein the product is fully exposed for use on a support, which package does not require a structure for elevating the product out of the package for use.

It has been desired to provide improved packages for deodorant stick products, wherein the package is simple—that is, does not require a mechanism for elevating the product out of a housing, which mechanism increases cost of the package and makes the package more complex.

U.S. Pat. No. 5,496,122 (Mennen, 1996) discloses a replaceable stick deodorant package wherein the product is completely exposed on a retaining member and the process by which such products may be manufactured. The composition is held on a retaining member which is snap-fit assembled into a handle.

U.S. Pat. No. 4,235,557 (Ethyl Corp., 1980) discloses a dispensing device for a hot-filled solid product, such as an antiperspirant stick composition, the composition being held on a product holding structure which is screw-fitted into a handle.

WO 2020/152223 (Unilever, 2020) discloses a deodorant stick product comprising a deodorant stick composition mounted on an axially immobile retaining member reversibly connected to a holder, the retaining member comprises arcuate bridge structures arcing into the deodorant stick composition and being embedded therein.

SUMMARY OF INVENTION

It is an object of the present invention to provide cosmetic stick compositions with a dispensing means that can be reused multiple times, thereby reducing the amount of packaging, in particular plastic packaging involved in the use of the compositions.

Current cosmetic stick compositions are generally packaged in plastic dispensers, the dispenser being used until composition is exhausted and then disposed of. The present invention enables the majority of the dispensing packaging to be reused with a new composition when the original one becomes exhausted. This greatly reduces the need packaging in using the invention.

It is an object of the present invention to provide cosmetic stick products that do not require an "elevator" mechanism for their operation.

Current cosmetic stick products generally comprise a stick composition surrounded on all sides by a plastic container and having some means, typically a platform and an associated spindle, designed to elevate the stick composition out of the top of the plastic container. The present invention does not require the use any such platform or spindle, further reducing the need for packaging/dispensing materials.

In a first aspect of the invention, there is provided a packaged cosmetic stick product comprising a cosmetic stick composition mounted on an axially immobile retaining member, the retaining member being reversibly connected to a holder enabling the cosmetic stick product to be held in the human hand, wherein the retaining member comprises parallel arcuate bridge structures separated by holes, the bridge structures arcing into the cosmetic stick composition and being embedded therein, characterised in that (i) two of the arcuate bridge structures which are adjacent curve towards one another at their upper ends in a direction orthogonal to their long axis; or (ii) two of the arcuate bridge structures as referred to in the preamble above, are surrounded on either side by two or more parallel bridge structures that do not necessarily arc into the cosmetic composition; or (iii) the bridge structures have upper and lower surfaces that are smoothly curved across their full width in a direction orthogonal to their long axis; or by having any combination of features (i) to (iii).

In a second aspect of the invention, there is provided a method of applying a cosmetic stick composition to the surface of the human body by use of a cosmetic stick product according to the first aspect of the invention, particularly to deliver a deodorancy benefit or to reduce perspiration.

The holder enables the cosmetic stick product to be easily held in one hand and for the composition to be applied to the desired surface.

A benefit of the invention is that the cosmetic stick composition can be placed or replaced in its holder without need for hand contact with the cosmetic stick composition.

DETAILED DESCRIPTION

Herein, features expressed as "preferred" with regard to a particular aspect of the invention should be understood to be preferred with regard to each aspect of the invention (likewise, features expressed as "more preferred" or "most preferred").

Herein, preferred features of the invention are particularly preferred when used in combination with other preferred features. Likewise, particularly preferred features and especially preferred features are even more preferred when used with other preferred, particularly preferred and especially preferred features of the invention.

Herein, "ambient conditions" refers to about 20° C. and 1 atmosphere pressure, unless otherwise indicated.

Herein, all numbers, amounts and ratios may optionally be understood to be modified by the word "about", unless otherwise indicated.

Herein, the word "comprising" is intended to mean "including" but not necessarily "consisting of", i.e., it is non-exhaustive.

Herein, "cosmetic" methods and compositions should be understood to mean non-therapeutic methods and compositions, respectively.

Herein, locational terms, such as terms denoting relative positioning, such as "upper", lower", "top", "bottom", refer to the stick product orientated such the cosmetic stick composition is immediately above its retaining member which is above the associated holder.

Herein, the term "cosmetic stick composition" may be abbreviated to "cosmetic stick" or simply "stick".

Herein, the terms "deodorant stick" and "deodorant composition" encompass antiperspirant sticks and compositions.

Cosmetic sticks that are deodorant sticks are particularly suitable for use with the present invention. Such sticks are capable of reducing body malodour following topical application. Topical application is typically achieved by drawing the top of the stick across the skin of the human body, particularly in the underarm regions.

The action of drawing the cosmetic stick across the skin and particularly the underarm regions places strong lateral forces on the stick, requiring it to have good physical strength and resistance to shear forces of this sort. The cosmetic products of the present invention are especially designed to resist these forces.

Herein, deodorant sticks are typically antiperspirant stick compositions, i.e. antiperspirant sticks. Such sticks are capable of reducing perspiration, following topical application, as well as reducing body malodour. Herein, references to deodorant sticks should be understood to apply equally to antiperspirant sticks.

The cosmetic sticks used in the invention are solid in nature, typically having a melting of greater than 40° C. at 1 atmosphere pressure. The cosmetic stick preferably has a melting point at 1 atmosphere pressure of greater than 50° C. and more preferably greater than 60° C. Whether the melting point at 1 atmosphere pressure is greater than 40° C., 50° C. or 60° C., the melting point is preferably less than 90° C.

Herein, a cosmetic stick is considered to have become molten when it is capable of flow solely under the influence of gravity and the melting point is defined as the temperature at which it becomes molten.

The cosmetic stick preferably has a hardness of at least 600 gram force, most typically from 600 gram force to 5000 gram force, preferably from 750 gram force to 2000 gram force, 5 more preferably from 800 gram force to 1400 gram force. This enables the stick to withstand the lateral forces encountered when it is topically applied. More particularly, it enables the stick to stay attached to its retaining member during such use.

Herein, the term "hardness" relates to how much force is required to move a penetration cone a specified distance and at a controlled rate into a cosmetic stick composition under the following test conditions. Values are measured at 27° C., 15% relative humidity, using a TA-XT2 Texture Analyzer, available from Texture Technology Corp., Scarsdale, NY., USA. The product hardness value represents the peak force required to move a standard 45° angle penetration cone through the composition for a distance of 10 mm at a rate of 2 mm/second. The standard cone is available from Texture Technology Corp., as part number TA-15, and has a total cone length of about 24.7 mm, angled cone length of about 18.3 mm, a maximum diameter of the angled surface of the cone of about 15.5 mm. The cone is a smooth, stainless steel construction and weighs 17.8 grams.

Cosmetic sticks of the invention typically do not require a plastic spindle running through them to aid in their elevation from their packaging; indeed, the absence of a central spindle running through the cosmetic stick composition is a preferred feature of cosmetic stick products of the present invention. The lack of a central spindle can have a detrimental effect of the structural strength of the stick and leads to relatively low preferred ratios of stick height to other dimensions (vide infra).

In preferred embodiments, the ratio of the height to the breadth of the cosmetic stick composition is from 1:2 to 3:2. It is particularly preferred that this ratio is from 2:3 to 4:3. Having the height of the cosmetic stick relative to the breadth of the cosmetic stick within these ranges has been found to enhance the strength of the stick composition and to reduce its tendency to fracture or shear off.

Herein, "stick breadth" is the minimum cross-sectional diameter of the product. For a stick having an oval cross-section, this equates to the minor axis of the oval.

Herein, "stick width" is the cross-sectional diameter of the product measured in a direction orthogonal to the stick breadth.

The ratio of stick breadth to stick width is preferably from 1:3 to 1:1 and more preferably from 1:2 to 1:1.

Herein, "oval" or "obround" cross-section is the cross-section when viewed from above.

In preferred embodiments, the ratio of the height of the cosmetic stick composition to the height of the holding material is from 1:2 to 3:2. It is particularly preferred that this ratio is from 2:3 to 1:1.

Herein, the "holding material" consists of the holder and the retaining member and the height of the holding material includes the height of both of these components when they are engaged.

Having the height of the cosmetic stick relative to the height of the holding material within these ranges has been found to enhance the strength of the stick composition and to reduce its tendency to fracture or shear off.

The cosmetic stick composition is generally formed and attached to the retention member by a hot-fill process whereby molten product is typically poured into a mould, placed in contact with the retaining member whilst still molten and then allowed to cool to form a solidified stick composition attached to the retention member.

The retaining member holds the stick composition on its upper surface. The retention of the stick composition is enhanced by the retaining member comprising arcuate bridge structures separated by holes, the bridge structures arcing into the cosmetic stick composition and being embedded therein.

The arcuate or curved bridge structures project upwards into the cosmetic composition. The arc or curve of the bridge structures is along the long axis of said bridge structures.

In preferred embodiments, the apex of the arcuate bridge structures is at their mid-points and is of the same height for each of the two arcuate bridge structures closest to the centre of the retaining member.

In preferred embodiments, the bridge structures are entirely within the cosmetic composition [when the product is fully assembled].

The holes pass fully through the retaining member from its upper surface to its lower surface. During manufacture, molten composition passes through the holes and surrounds the upwardly curving bridge structures. When the composition is solidified, the bridge structures are embedded therein. This greatly strengthens the retention of the stick composition by the retaining member, reducing the likelihood that the stick composition becomes fractured or shears off during use.

The axial immobility of the retaining member differentiates it from the majority of 'platforms' used in conventional cosmetic sticks. The axial immobility of the retaining member is relative to the holder and any other associated elements.

The retaining member comprises one or more of three supplementary retention features:

(i) two adjacent arcuate bridge structures which curve towards one another at their upper ends in a direction orthogonal to their long axis;

(ii) two arcuate bridge structures surrounded on either side by two or more parallel bridge structures that do not necessarily arc into the cosmetic composition;

(iii) bridge structures having upper and lower surfaces that are smoothly curved across their full width in a direction orthogonal to their long axis.

Having adjacent actuate bridge structures curve towards one another as in feature (i) helps reduce sheer stress close on the composition to the bridge structure when lateral force is applied thereto, thereby assisting its retention on the retaining member. It can also improve retention when axial force is applied, as when the retaining member and its associated composition are pulled from packaging material or a mould used in production.

Having two arcuate bridge structures surrounded on either side by two or more parallel bridge structures improves the binding the composition to the retaining member. Having said that, having too many bridge structures embedded in the composition can weaken its cohesion; hence, it is preferred that there are no more than two parallel bridge structures on either side of the two arcuate bridge structures.

Having bridge structures that have surfaces that are smoothly curved, as in feature (iii), reduces the shear stress in the composition around such surfaces when lateral forces are applied to the stick, compared with bridge structures having sharp edges.

In preferred embodiments, the retaining member comprises two or more of the above supplementary retention features. Hence, preferred embodiments comprise (a) both features (i) and (ii); or both features (i) and (iii); or both features (ii) and (iii).

In particularly preferred embodiments, the retaining member comprises each of features (i), (ii) and (iii).

When supplementary retention feature (i) is present, it is preferred that the two adjacent arcuate bridge structures are centrally located across the horizontal plane of the retaining member, one either side of a diameter or long axis of the retaining member. It is further preferred that these arcuate bridge structures are mirror images of one another across an axial plane passing midway between them.

It is preferred that two adjacent arcuate bridge structures have the same apex height and penetrate into the stick composition for from 10 to 40% of the maximum height of the stick composition, measured from the bottom of the stick formulation to the apex of the arcuate bridge structures. Preferably, this penetration is from 25 to 35%. In particularly preferred embodiments, the arcuate bridge structures penetrate into the stick composition at from 20% of the maximum height of the stick composition measured from the bottom of the composition to the edge of arcuate bridge structure to 30% of the maximum height of stick composition, measured from the bottom of the stick formulation to the apex of the arcuate bridge structures. Too little penetration results in inferior binding to the composition to the retaining member and too much penetration leaves too much composition on the retaining member when the stick is used to its maximum extent.

Feature (ii), "two arcuate bridge structures surrounded on either side by two or more parallel bridge structures that do not necessarily arc into the cosmetic composition" means that the two arcuate bridge structures have, on each side, two or more parallel bridge structures that do not necessarily arc into the cosmetic composition.

When supplementary retention feature (ii) is present, it is preferred that the sets of two or more parallel bridge structures are equally spaced either side of a diameter or long axis of the retaining member, across the horizontal plane of the retaining member. It is further preferred that each set of the parallel bridge structures consists of precisely two bridge structures. It is independently preferred that the parallel bridge structures are linear and are not arcuate.

It is preferred that at least one of each set of the parallel bridge structures of feature (ii) passes across the full width of the retention member at the position at which it sits.

With reference to feature (iii), each, i.e. every, bridge structure present, has upper and lower surfaces that are both smoothly curved across their full width in a direction orthogonal to their long axis.

When supplementary retention feature (iii) is present, it is preferred that all of the bridge structures have upper and lower surfaces that are smoothly curved across their full width in a direction orthogonal to their long axis, including any parallel bridge structures as referred to in supplementary retention feature (ii).

In preferred embodiments, the product has an oval or obround cross-section and especially an oval cross-section. In such embodiments, it is preferred that the arcuate bridge structures pass across the length of the retaining member in a direction parallel to the major axis of the product.

In embodiments having an oval or obround cross-section, it is preferred that the arcuate bridge structures run parallel to the long axis of the product. This is particularly so for the two adjacent arcuate bridge structures as described in feature (ii), when this feature is present.

In preferred embodiments, the arcuate bridge structures have one or more strengthening struts running between them in a direction orthogonal to their long (major) axis. In particularly preferred embodiments, there is a strengthening strut running between each of the bridge structures in a direction orthogonal to their long axis. It is preferred that the strengthening struts also support any additional parallel bridge structures present in accordance with supplementary retention feature (ii).

The one or more strengthening struts as referred to in the paragraph immediately above are particularly preferred in embodiments having an oval or obround cross-section, especially when the arcuate bridge structures pass across the length of the retaining member in a direction parallel to the major axis of the product. In such embodiments, it is especially preferred that the product has an oval cross-section.

The strengthening strut(s) not only aid the robustness of the arcuate bridge structures, but can also contribute to the retention of the stick composition by the retaining member. It is preferred that one or more, preferably two, strengthening struts are present-having more present can adversely affect the cohesion of the stick composition (vide supra). When multiple strengthening struts are present, it is preferred that they are evenly spaced.

When present, it is preferred that the strengthening strut(s) has/have upper and lower surfaces, particularly upper surfaces, that are smoothly curved across their full width in a direction orthogonal to their long axis.

When present, it is preferred that the strengthening strut(s) are linear and are not arcuate.

The retaining member may be reversibly connected to the holder by any suitable means. For example, the two may be held together by a screw-fitting, by a simple friction fit or snap fit, by means of magnets, by other mechanism means.

The holder is designed to reversibly connect with the retaining member and is designed to allow the product to be held in the human hand. The holder enables easy application of the cosmetic stick composition to the skin of the human body.

In preferred embodiments, the holder has a flat base. This allows the product to sit conveniently on a flat surface such as a bathroom shelf.

In preferred embodiments, the cosmetic stick product comprises a cap which sits over the cosmetic stick composition and contacts the holder.

The packaging components (e. g. retaining member and holder) according to the present invention can be made of conventional materials for solid stick product packages (e. g. plastic materials). The packaging components can be made by conventional injection moulding techniques, with the material of construction preferably being a thermoplastic material having suitable rigidity to withstand forces which the device will experience when the product is filled by a hot-fill technique into the package and when the consumer uses the product. The materials of construction must be able to withstand hot-fill temperatures without deformation, having a heat of deformation of greater than 50° C., preferably greater than 60° C., more preferably greater than 70° C. and most preferably greater than 80° C. Exemplary of materials that may be used are polyolefins, such as polypropylene or polyethylene, in particular high density polyethylene (HDPE).

SPECIFIC EMBODIMENTS AND TESTING

FIG. 1 illustrates a retaining member (1) suitable for use in accordance with the present invention.

Figure 1:
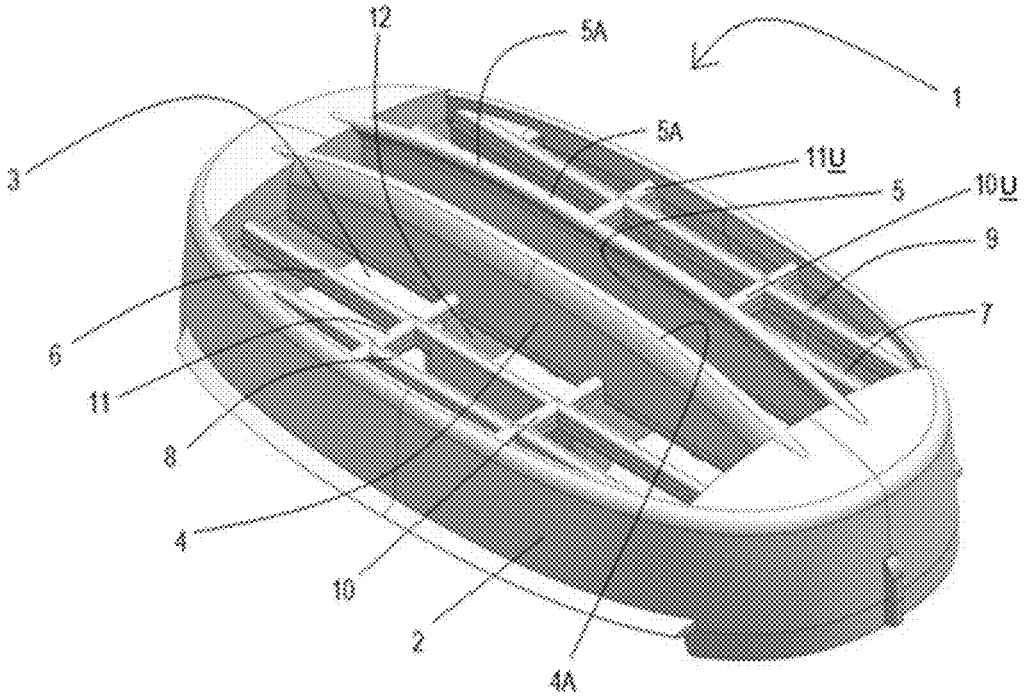
FIG. 1 is an isometric view of a retaining member (1) as used in accordance with the present invention.

The retaining member (1) is of oval cross-section and comprises an outer skirt (2) surrounding an inner "cavity" or "holes" (3). Spanning the major axis of the retaining member (1) there are two arcuate bridge members (4 and 5) spanning the cavity (3). These arcuate bridge members (4 and 5) are mirror images of one another and curve towards each other at their upper ends (4A and 5A).

On either side the arcuate bridge members (4 and 5), there are sets of two parallel bridge structures comprising inner bridge structures (6 and 7) and outer bridge structures (8 and 9). These bridge structures are parallel to each other and to the arcuate bridge members (4 and 5), They span the inner cavity (3) of the retaining member (1) at the positions at which they sit.

The inner (6 and 7) and outer (8 and 9) parallel bridge structures have upper surfaces that are smoothly curved across their full width in a direction orthogonal to their long axis. They also have lower surfaces (not illustrated in FIG. 1, but see FIG. 5) that are smoothly curved across their full width in a direction orthogonal to their long axis.

The inner (6 and 7) and outer (8 and 9) parallel bridge structures are linear and are not arcuate; hence, they do not penetrate into the stick composition (when present) to same extent as the two arcuate bridge members (4 and 5). Nevertheless, these bridge structures are fully covered by the stick composition when the product is fully assembled (see FIG. 5).

Orthogonal to the arcuate bridge members (4 and 5) and the surrounding parallel bridge members (6, 7, 8 and 9) there are two strengthening struts (10 and 11). These also have upper surfaces (10U and 11U) and lower surface (not illustrated) that are smoothly curved across their full width in a direction orthogonal to their long axis.

The strengthening struts (10 and 11) are linear and are not arcuate; hence, they do not penetrate into the stick composition (when present) to same extent as the two arcuate bridge members (4 and 5). Nevertheless, these bridge structures are fully covered by the stick composition when the product is fully assembled.

On the underside of the retaining member (1) there is a linkage element (12) designed to reversible link with a holder (not illustrated) for the retaining member (1) and its associated stick composition, when present. Features of this type are fully disclosed in the prior art and are not further described herein.

Figure 4:
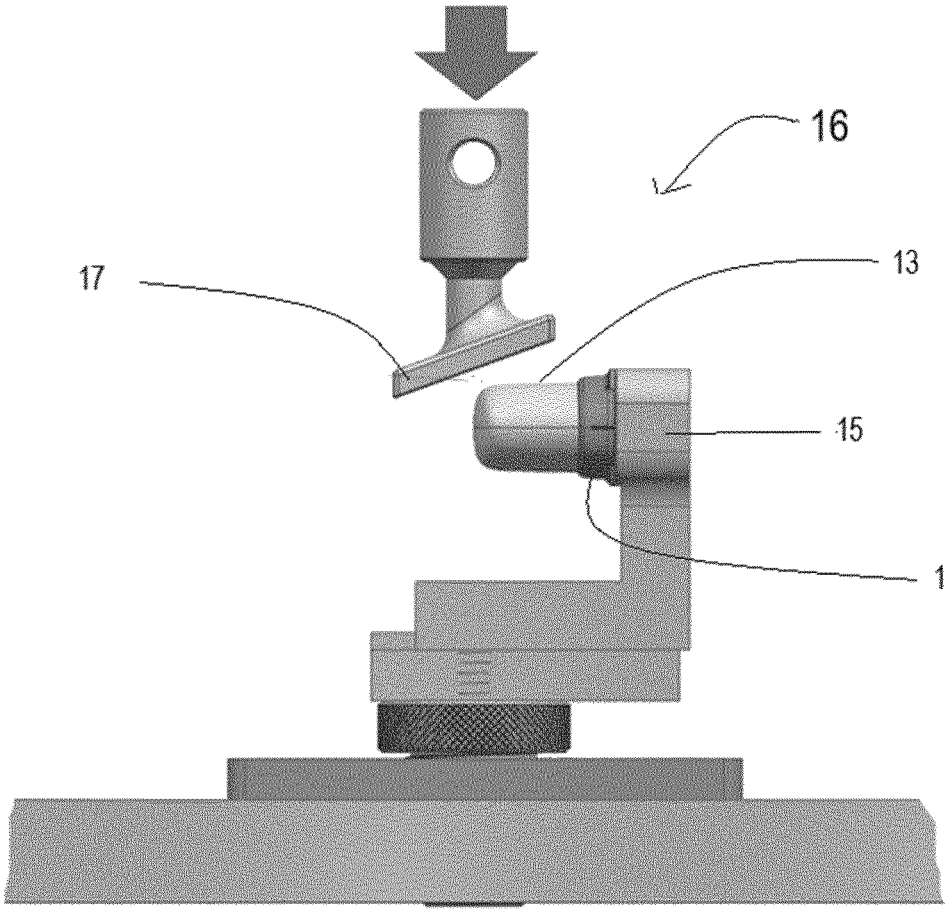
FIG. 4 is a view of the equipment set-up used to perform the Lateral Force Resistance Tests described hereinafter.

FIG. 4 illustrates the equipment (16) used to perform the lateral force resistance tests described hereinbelow. The Figure shows a stick composition (13) attached to its retention member (1) and held firmly in a horizontal direction by a holding element (15) of the equipment (16). A mechanical force gauge (not illustrated) applies a controlled top load (force) onto the stick (13) until the stick fractures. The force is applied to the stick (13) via a plate (17) angled at 20° to the horizontal which contacts an upper outside edge of the stick (13) and applies downward pressure thereto.

Figure 5:
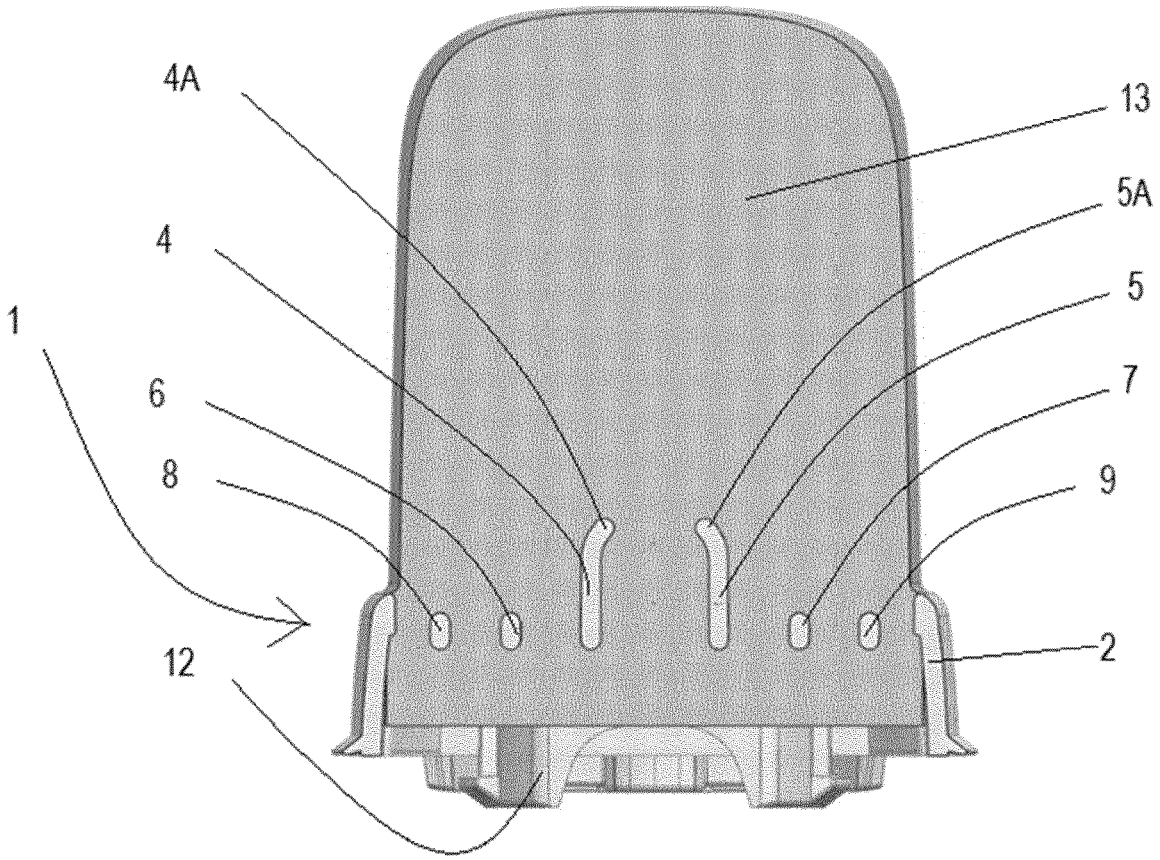
FIG. 5 is a cross-sectional view of the retaining member (1) as illustrated in FIG. 1, together with an associated cosmetic stick (20).

FIG. 5 shows the cross-sectional shape of various elements of the retaining element (1) and also their interrelationship with an associated cosmetic stick (13).). It can be seen that the arcuate bridge members (4 and 5) curve towards one another at their upper ends in a direction orthogonal to their long axis. It can also be seen that the arcuate bridge members (4 and 5) and the inner (6 and 7) and outer (8 and 9) parallel bridge structures have upper and lower surfaces that are smoothly curved across their full width in a direction orthogonal to their long axis and that these features are fully embedded in the stick composition.

FIG. 5 also shows the linkage element (12) designed to reversible link with a holder (not illustrated). Such features are known in the art and are described in documents such as WO 2020/152223 (Unilever, 2020), for example.

Figure 2:
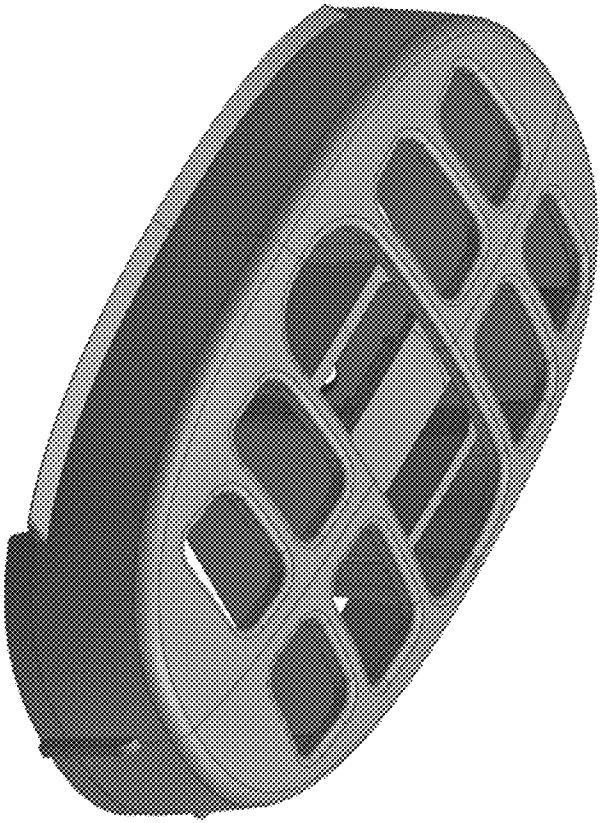
FIG. 2 is an isometric view of a retaining member as described in prior art publication WO 2020/152223 (Unilever, 2020) and is not described further herein.
Figure 3:
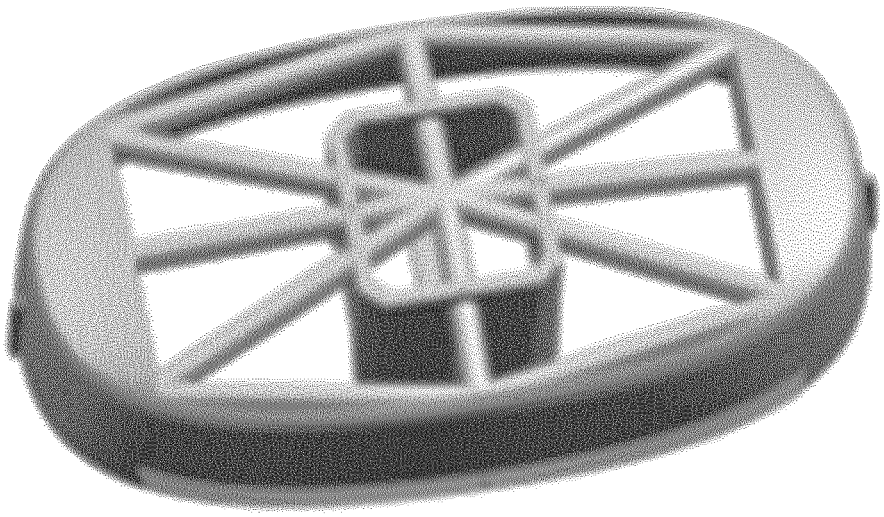
FIG. 3 is a perspective view of an alternative retaining member not suitable for use in accordance with the present invention and is not described further herein.

The retaining members illustrated in FIGS. 1, 2 and 3 were each tested to assess their ability to resist lateral force applied to a cosmetic stick composition associated with the retaining member. The same cosmetic composition was used for each test: a deodorant stick composition structured with sodium stearate. The compositions were added to the retaining members by pouring molten deodorant composition through the holes in the retaining member and into a polyurethane mould (not illustrated), filling to a level just beyond the bridge structures of the retaining member. The compositions were then allowed to cool and solidify and the moulds were subsequently removed.

Each of the retention members was manufactured in the same manner (3D-printing) and from the same material, an acrylic-based photo-polymer.

The test involved the use of a 100 N mechanical force gauge on a motorised test stand and its use is illustrated in FIG. 4 and described below. The cosmetic stick composition and its associated retaining member were fitted into a holder in accordance with the invention and the holder was firmly clamped such that the stick composition extended horizontally outwards. A plate angled at 20° from the horizontal was advanced from the top into a top side area of the cosmetic composition at a speed of 160 mm/min., as illustrated in FIG. 4.

The force required to shear the cosmetic composition from its retaining member was measured 8 times for each retaining member. This force is herein referred to as the "retention force". High retention force indicates a good ability for the retaining member to stay attached the cosmetic composition during conventional use of the product. The results are summarised in Table 1.

TABLE 1

| | Retention Force (N) | |
|---|---|---|
| Retaining feature | Mean | Std. Dev. |
| As in FIG. 1 | 61.66 | 1.40 |
| As in FIG. 2 | 44.84 | 1.27 |
| As in FIG. 3 | 53.49 | 3.84 |

The retention member as illustrated in FIG. 1 was found to have the highest retention force and the retention member as illustrated in FIG. 2 had the lowest. The retention member as illustrated in FIG. 3 had a higher retention force than that according to FIG. 2 possibly as a result, in part, of the bridge structures present therein having upper and lower surfaces that are smoothly curved across their full width in a direction orthogonal to their long axis.

The invention claimed is:

1. A packaged cosmetic stick product comprising a cosmetic stick composition mounted on a retaining member, the retaining member being reversibly connected to a holder enabling the cosmetic stick product to be held in a human hand, wherein the retaining member is axially immobile relative to the holder and any other associated elements and wherein the retaining member comprises parallel arcuate bridge structures separated by holes, the arcuate bridge structures arcing into the cosmetic stick composition and being embedded therein, characterised in that (i) two of the arcuate bridge structures which are adjacent, curve towards one another at their upper ends in a direction orthogonal to their long axis; or (ii) two of the arcuate bridge structures have on each side two or more parallel bridge structures that do not arc into the cosmetic composition; or (iii) the arcuate bridge structures each have both upper and lower surfaces that are smoothly curved across their full width in a direction orthogonal to their long axis; or by having any combination of features (i) to (iii).

2. A cosmetic stick product according to claim 1, wherein a ratio of a height to a breadth of the cosmetic stick composition is from 1:2 to 3:2.

3. A cosmetic stick product according to claim 1, wherein a ratio of a breadth to a width of the cosmetic stick is from 1:3 to 1:1.

4. A cosmetic stick product according to claim 3, wherein the ratio of the breadth to the width of the cosmetic stick is from 1:2 to 1:1.

5. A cosmetic stick product according to claim 1, wherein the product has an oval or obround cross-section when viewed from above.

6. A cosmetic stick product according to claim 5, wherein the parallel arcuate bridge structures span a long axis of the product.

7. A cosmetic stick product according to claim 1, wherein the arcuate bridge structures have one or more strengthening struts running between them in a direction orthogonal to their long (major) axis.

8. A cosmetic stick product according to claim 7, wherein the strengthening struts and the arcuate bridge structures have upper surfaces that are smoothly curved across their full width in a direction orthogonal to their long axis.

9. A cosmetic stick product according to claim 8, wherein the strengthening struts and the arcuate bridge structures have lower surfaces that are smoothly curved across their full width in a direction orthogonal to their long axis.

10. A cosmetic stick product according to claim 1, wherein two arcuate bridge structures are surrounded on either side by a set of two or more parallel bridge structures that do not arc into the cosmetic composition.

11. A cosmetic stick product according to claim 10, wherein at least one of each set of the parallel bridge structures passes across the full width of the retaining member at a position at which it sits.

12. A cosmetic stick product according to claim 10, wherein the parallel bridge structures have upper surfaces that are smoothly curved across their full width in a direction orthogonal to their long axis.

13. A cosmetic stick product according to claim 12, wherein the parallel bridge structures have lower surfaces that are smoothly curved across their full width in a direction orthogonal to their long axis.

14. A cosmetic stick product according to claim 1, wherein both the arcuate bridge structures and the parallel bridge structures are entirely within the cosmetic stick composition.

15. A cosmetic stick product according to claim 1, wherein the cosmetic stick composition is a deodorant stick composition.

* * * * *